US009666007B2

(12) United States Patent
Hecht et al.

(10) Patent No.: US 9,666,007 B2
(45) Date of Patent: May 30, 2017

(54) METHOD AND APPARATUS FOR HANDLING VALUE DOCUMENTS

(71) Applicant: GIESECKE & DEVRIENT GMBH, München (DE)

(72) Inventors: Matthias Hecht, Neubiberg (DE); Karl-Dieter Förster, Deisenhofen (DE); Walter Herrmann, München (DE)

(73) Assignee: GIESECKE & DEVRIENT GMBH, Munich (DE)

( * ) Notice: Subject to any disclaimer, the term of this patent is extended or adjusted under 35 U.S.C. 154(b) by 0 days.

(21) Appl. No.: 15/104,657

(22) PCT Filed: Dec. 16, 2014

(86) PCT No.: PCT/EP2014/003368
§ 371 (c)(1),
(2) Date: Jun. 15, 2016

(87) PCT Pub. No.: WO2015/090560
PCT Pub. Date: Jun. 25, 2015

(65) Prior Publication Data

US 2016/0321851 A1 Nov. 3, 2016

(30) Foreign Application Priority Data

Dec. 18, 2013 (DE) ..... 10 2013 021 655

(51) Int. Cl.
*G07D 7/00* (2016.01)
*G08B 21/02* (2006.01)
(Continued)

(52) U.S. Cl.
CPC ..... *G07D 7/00* (2013.01); *G07D 11/0006* (2013.01); *G07D 11/0021* (2013.01);
(Continued)

(58) Field of Classification Search
CPC ... G07D 7/00; G07D 11/0051; G07D 11/0081
See application file for complete search history.

(56) References Cited

U.S. PATENT DOCUMENTS

2002/0029357 A1* 3/2002 Charnell ..... G06F 8/4442 714/5.11
2004/0205025 A1 10/2004 Takeuchi et al.
(Continued)

FOREIGN PATENT DOCUMENTS

DE 102010045879 A1 3/2012
DE 102011121877 A1 6/2013
(Continued)

OTHER PUBLICATIONS

German Search Report for corresponding German Application No. 102013021655.9, Nov. 25, 2014, (10 pages).
(Continued)

*Primary Examiner* — Mark Beauchaine
(74) *Attorney, Agent, or Firm* — Workman Nydegger

(57) ABSTRACT

A method for processing value documents includes employing a storage device for data which has a storage area of pre-specified storage-area size, wherein value documents are transported in singled form to a sensor device. Respective value document measuring data are captured by means of the sensor device. A storage priority is established for the respective value document as a pre-specified function of at least a portion of the measuring data that is necessary for establishing the storage priority in dependence on the established storage priority processing data for the respective value document stored in a storage block in the storage area. The storage priority influences the duration of the storage of the respective processing data.

14 Claims, 3 Drawing Sheets

(51) Int. Cl.
*G08B 21/24* (2006.01)
*G07D 11/00* (2006.01)

(52) U.S. Cl.
CPC ..... *G07D 11/0066* (2013.01); *G07D 11/0078* (2013.01); *G08B 21/02* (2013.01); *G08B 21/24* (2013.01)

(56) References Cited

U.S. PATENT DOCUMENTS

| | | | | |
|---|---|---|---|---|
| 2012/0185657 | A1 | 7/2012 | Gokhale et al. | |
| 2012/0278566 | A1 | 11/2012 | Gilson | |
| 2013/0248320 | A1* | 9/2013 | Tomizawa ..... | G07D 11/0072 194/206 |
| 2013/0317960 | A1* | 11/2013 | Holl ..... | G07D 7/0033 705/35 |
| 2014/0348413 | A1 | 11/2014 | Hecht et al. | |
| 2016/0063791 | A1 | 3/2016 | Su et al. | |

FOREIGN PATENT DOCUMENTS

| | | | |
|---|---|---|---|
| DE | 102013006925 | A1 | 10/2014 |
| WO | 2013111392 | A1 | 8/2013 |

OTHER PUBLICATIONS

International Preliminary Report on Patentability for corresponding International PCT Application No. PCT/EP2014/003368, Jun. 21, 2016, (9 pages).
International Search Report for corresponding International PCT Application No. PCT/EP2014/003368, Mar. 17, 2015, (5 pages).

* cited by examiner

METHOD AND APPARATUS FOR HANDLING VALUE DOCUMENTS

BACKGROUND

The present invention concerns a method for processing value documents and an apparatus for carrying out said method.

Value documents are understood here to be sheet-shaped objects that represent for example a monetary value or an authorization and hence should not be manufacturable arbitrarily by unauthorized persons. They hence have features that are not simple to manufacture, in particular to copy, whose presence is an indication of authenticity, i.e. manufacture by an authorized body. Important examples of such value documents are coupons, vouchers, checks and in particular bank notes.

Value documents must frequently be checked for whether they are to be regarded as authentic and/or what state they are in. The state of bank notes can be given for example by association with classes such as "fit for circulation" and/or "unfit for circulation" and/or "damaged" or "damaged" in connection with the kind of damage.

For checking large amounts of value documents, value-document processing apparatuses are often used. Such apparatuses, in particular bank-note processing apparatuses, classify value documents, in particular bank notes, with regard to value-document type, in the case of bank notes with regard to currency and/or value, and/or authenticity and/or orientation and/or in particular state. The orientation of a value document, assuming a rectangular value document, will hereinafter be understood to be one of the four possible positions that can be obtained by rotating the value document around its longitudinal and transverse axes by 180° in each case. In dependence on the classification, the value documents can then for example be sorted and, where applicable, deposited in corresponding output regions. This will be explained by the example of value documents in the form of bank notes.

Classification is effected on the basis of different physical properties of the individual, i.e. respectively processed, bank note. Examples of such physical properties are optical properties, for example color properties, magnetic properties or ultrasonic properties.

Upon capture of the different physical properties of the individual, i.e. respectively yet to be processed or already processed, bank note, measuring data which are employed for the classification are generated by means of sensors upon the processing of bank notes in bank-note processing apparatuses. The measuring data of a respective sensor describe the physical property or properties captured by the respective sensor. Measuring data will hereinafter be understood in general to be in particular raw data formed by a sensor, which are unprocessed apart from some processing operations in the sensor and/or corrections, for example also with regard to calibration and/or removal of noise components or background components.

The measuring data delivered by the sensors are evaluated in an attached evaluation device, which can also be configured at least partly for controlling the value-document processing apparatus or as a control and evaluation device. Upon said evaluation, bank-note features characterizing bank-note type, authenticity and quality of the bank note are determined by suitable evaluation methods. In dependence on the determined bank-note features there is then computed by the evaluation device a classification result, which subsequently determines which output pocket of the bank-note processing apparatus the bank note is to be deposited in. When the evaluation device is configured as a control and evaluation device, the latter can actuate a transport device of the bank-note processing apparatus in dependence on the classification result. Until the classification result is obtained, processing data are generated for the respective value document, said data being hereinafter understood to be a portion or all of the measuring data and/or data established therefrom, for example value-document features or, in the case of bank notes, bank-note features.

The evaluation methods and the establishment of the classification result must be adapted to the type of bank notes to be processed and also to the requirements of the operators of bank-note processing apparatuses. For this purpose, the evaluation device, preferably at least an evaluation program running therein, is parameterizable, i.e. there are classification parameters present whose values can be pre-specified and which are employed upon evaluation and classification or establishment of the classification result; said adapting of the classification parameter values, also designated as adapting of the classification parameters, will hereinafter be designated as adaptation. To establish appropriate classification parameters, the measuring data of corresponding, suitably pre-specified bank notes are frequently employed for adapting the classification parameters. More precisely, in a first step, upon a measuring-data acquisition for the pre-specified bank notes with the bank-note processing apparatus, corresponding measuring data are captured and lastingly stored. Said measuring data are then, in a second step, utilized for establishing the classification parameter values.

When such adapting is carried out, it can happen that certain bank notes cannot be classified as well as would be desirable. Particularly also in normal operation of the apparatus, it can happen that the classification of certain bank notes causes difficulties. In both cases it may be desirable to obtain processing data, for example measuring data, for certain bank notes which are difficult to classify with certainty.

Due to the often very great processing speeds of modern value-document processing apparatuses and/or the high resolving power of optical sensors employed therein, processing gives rise to a great stream of processing data, in particular when the latter comprise measuring data. It is hence not readily possible to store said data for later examinations for a longer time, in particular lastingly, i.e. beyond the end of the transporting of value documents. In particular, processing data of value documents with certain pre-specified properties cannot readily be stored for later employment.

SUMMARY

The present invention is hence based on the object of providing a method for processing value documents that makes it possible to simply store processing data for value documents that are processed at high speed and have pre-specified properties. Further, means are to be stated for carrying out said method.

This object is achieved by a method for processing value documents, employing a storage device for data which has a storage area of pre-specified storage-area size, wherein value documents are transported in singled form to a sensor device, for a respective value document there are captured by means of the sensor device measuring data which describe at least one physical property of the value document, for the respective value document a storage priority is established as a pre-specified function of at least a portion of the measuring data that is necessary for establishing the storage priority, in dependence on the established storage priority processing data for the respective value document are stored in a storage block in the storage area, wherein the processing data comprise at least a portion of the measuring data that is provided for storage and/or property data for at least one property of the value document which are established employing at least a portion of the measuring data that is necessary for establishing the property, and wherein the storage priority influences the duration of the storage of the respective processing data.

The object is further achieved by an apparatus for processing value documents, having a transport device which is configured for transporting singled value documents, a sensor device which is set up for capturing, for one of the value documents transported by the transport device in each case, measuring data which describe at least one physical property of the value document, and an evaluation device which has at least a processor and a storage device which has a storage area of pre-specified storage-area size, wherein the apparatus is configured for performing a method according to the invention, wherein measuring data of the sensor device are employed as measuring data, and the storage device of the evaluation device as a storage device. In particular, the apparatus is thus configured for, while employing the storage device as a storage device for data which has a storage area of pre-specified storage-area size, transporting value documents in singled form to a sensor device, capturing for a respective value document by means of the sensor device measuring data which describe at least one physical property of the value document, establishing for the respective value document a storage priority as a pre-specified function of at least a portion of the measuring data that is necessary for establishing the storage priority, and storing processing data for the respective value document in a storage block in the storage area in dependence on the established storage priority. The processing data comprise at least a portion of the measuring data that is provided for storage and/or property data for at least one property of the value document which are established employing at least a portion of the measuring data that is necessary for establishing the property, and the storage priority influences the duration of the storage of the respective processing data. Preferably, the evaluation device is configured for establishing for the respective value document a storage priority as a pre-specified function of at least a portion of the measuring data that is necessary for establishing the storage priority, and storing processing data for the respective value document in a storage block in the storage area in dependence on the established storage priority.

In the method, the value documents are transported in singled form to the sensor device, in particular the sensor device of the value-document processing apparatus. This can be done using the transport device of the value-document processing device. For singling value documents, the value-document processing apparatus can further have a singler which singles value documents of a stack and feeds them to the transport device.

The sensor device captures at least one physical property of a respective value document. It can for this purpose have one or a plurality of sensors. When only one sensor is present, it is configured for capturing the at least one physical property. When a plurality of physical properties are captured, there can also be employed a plurality of sensors which respectively capture at least one of the plurality of physical properties. Examples of the properties of a value document are its remission and/or transmission properties in the visible region of the electromagnetic spectrum, in particular also resolved according to wavelengths or colors, the remission and/or transmission properties in the infrared and/or ultraviolet spectral region of the electromagnetic spectrum, luminescence properties, magnetic properties, or remission or transmission properties for ultrasound in pre-specified frequency ranges, as well as properties derived therefrom. Accordingly, the sensor device can have at least one optical sensor, in particular a color sensor and/or at least one IR sensor and/or a UV sensor, at least one luminescence sensor and/or a magnetic sensor and/or at least one ultrasonic sensor. Upon capture, the sensor device or its sensor or sensors form sensor signals from which the measuring data can be obtained or which represent the measuring data. The measuring data are then captured, preferably by means of the evaluation device, and can be stored at least temporarily.

For storing the processing data, the storage device is provided. As a storage device there is preferably employed a storage device in which processing data can be stored fast, preferably in real time, for example an adequately fast RAM memory. The storage device supplies, for storage, the storage area of pre-specified storage-area size which stands ready to supply the storage blocks. A storage block is understood within the context of the present invention to be a non-contiguous or preferably a contiguous storage area whose size is sufficient for receiving the data to be stored.

For storage it is provided according to the invention that for the respective value document or the processing data for the value document there is established a storage priority which determines how long the processing data are stored.

More precisely, by means of a data processing device, preferably the evaluation device, a storage priority is established for the respective value document or the processing data for the respective value document. Storage priorities are understood here to be numbers or data representable as such. Although the storage priority can basically assume arbitrary values, it is preferred that, in the method, discrete pre-specified values are pre-specified as possible values for the storage priority, the number of the pre-specified values particularly preferably being greater than one and smaller than five.

The storage priority is established as a pre-specified function of at least a portion of the measuring data that is necessary for establishing the storage priority. That is to say, the storage priority is established as a pre-specified function of a portion of the measuring data that is necessary for establishing the storage priority or of all the measuring data. Establishment can be effected directly or in such a way that data describing at least one property of the value document are first established from the measuring data and are then employed further for establishing the storage priority. The processing data can then preferably comprise the value for the property as property data. Establishment of the storage priority as a function of at least a portion of the measuring data that is necessary for establishment thereof is preferably effected by a pre-specified establishment method which is so chosen that processing data for value documents with pre-specified properties are stored longer due to the established storage priority than processing data for value documents not having said pre-specified features.

Capture of the sensor data and establishment of the storage priority can, in the apparatus, preferably be effected by means of the evaluation device.

Depending on the established storage priority, the processing data for the respective value document are then stored in a storage block in the storage area, with the storage priority comprising at least indirectly the duration of the storage of the respective processing data. The processing data comprise at least a portion of the measuring data that is provided for storage or all of the measuring data and/or property data for at least one property of the value document which are established employing at least a portion of the measuring data that is necessary for establishing the property or the corresponding property data. Preferably, the processing data comprise, besides the property data, also the measuring data employed for establishment thereof.

The evaluation device of the apparatus has the storage device for storing the processing data. In the apparatus, the evaluation device can be configured in particular for performing those operations that concern the establishing of the storage priority and the storing of the processing data. For this purpose, it can have one or a plurality of processors or processor cores as well as a computer program with code upon whose execution they perform operations concerning the establishing of the storage priority and the storing.

The processing data stored longer are then available longer for further employment and do not need to be overwritten fast. Thus, in spite of high processing speeds, processing data for certain value documents given by the pre-specified function can be stored and held simply, in particular also longer.

In dependence on the established storage priority for the respective, i.e. current, value document and in dependence on the employment of the storage blocks for storing processing data for other, i.e. previously processed, value documents, a storage block that has been employed for storing processing data for another value document can preferably be employed for storing the processing data of the respective value document. In so doing, the processing data in a storage block can be overwritten with processing data for another value document. However, the processing data for the other value document can also first be deleted before new processing data are written to the storage block. In the apparatus, the evaluation device can preferably be configured for employing a storage block that has been employed for storing processing data for another value document for storing the processing data of the respective value document, in dependence on the established storage priority for the respective value document and in dependence on the employment of the storage blocks for storing processing data for other value documents. That is to say, if at least one storage block is available that has not been utilized for storing processing data, said storage block is employed. If no storage block not utilized for storing processing data is available, the processing data in one of the storage blocks are overwritten. This has the consequence that processing data for value documents with a higher storage priority remain stored longer than others.

Preferably, in the method, the established storage priority can be associated with the respective storage block in connection with the storing of the processing data in the respective storage block, there being employed as a storage block, if available, a part of the storage area that contains no storage block or no part of a storage block with which a storage priority is associated, or there being employed as a storage block, if no such part of the storage area is available, a part of the storage area that has at least one storage block with which the lowest storage priority of the storage blocks with an associated storage priority is associated. In the apparatus, the evaluation device can be configured for associating the established storage priority with the respective storage block in connection with the storing of the processing data in the respective storage block, there being employed as a storage block, if available, a part of the storage area that contains no storage block or no part of a storage block with which a storage priority is associated, or there being employed as a storage block, if no such part of the storage area is available, a part of the storage area that has at least one storage block with which the lowest storage priority of the storage blocks with an associated storage priority is associated. Alternatively, it is possible that unutilized storage blocks are also always assigned the lowest storage priority. Then, in the method, the established storage priority can be associated with the respective storage block in connection with the storing of the processing data in the respective storage block, there being employed as a storage block a part of the storage area that comprises at least one storage block with which the lowest storage priority of the storage blocks with an associated storage priority is associated. In the apparatus, the evaluation device can be configured for associating the established storage priority with the respective storage block in connection with the storing of the processing data in the respective storage block, there being employed as a storage block a part of the storage area that comprises at least one storage block with which the lowest storage priority of the storage blocks with an associated storage priority is associated.

In the method, the size of the storage blocks can in principle be variable and be chosen for example in dependence on the quantity of the processing data that is to be stored and/or a compression in dependence on the storage priority. In the latter case, the compression can be effected for example only at high storage priorities, while at low storage priorities no compression is effected. However, it is preferred that the storage blocks have a pre-specified equal size. The storage device then thus has as a storage area of pre-specified storage-area size a storage area with storage blocks of pre-specified size. The number thereof is then determined or pre-specified by the storage-area size and the size of the storage blocks. Since the storage area then has a pre-specified number of storage blocks of pre-specified size, the handling of the storage blocks can be effected especially fast, since no adapting of the storage-block size is necessary.

In the method, the established storage priority can then preferably be associated with the respective storage block in connection with the storing of the processing data in the respective storage block, there being employed as a storage block, if available, a storage block with which no storage priority is associated, or there being employed as a storage block, if no such storage block is available, a storage block with which the lowest storage priority of the storage blocks with an assigned storage priority is associated. In the apparatus, the evaluation device can be configured for associating the established storage priority with the respective storage block in connection with the storing of the processing data in the respective storage block, there being employed as a storage block, if available, a storage block with which no storage priority is associated, or there being employed as a storage block, if no such storage block is available, a storage block with which the lowest storage priority of the storage blocks with an assigned storage priority is associated. In this connection, the storage priorities are so pre-specified that processing data for value documents with a higher storage priority are to be stored longer than those for value documents with a lower storage priority. Alternatively, it is possible that unutilized storage blocks are also always assigned the lowest storage priority. Then, in the method, the established storage priority can be associated with the respective storage block in connection with the storing of the processing data in the respective storage block, there being employed as a storage block a storage block with which the lowest storage priority of the storage blocks with an assigned storage priority is associated. In the apparatus, the evaluation device can then be configured for associating the established storage priority with the respective storage block in connection with the storing of the processing data in the respective storage block, there being employed as a storage block a storage block with which the lowest storage priority of the storage blocks with an assigned storage priority is associated. In this manner, a scaling of the storage durations can be attained in particular when more than two storage priorities are employed.

According to a preferred embodiment, in the method, the storage blocks of one storage priority in each case can have associated therewith an order of the association of the respective storage priority therewith, and there can be employed as a storage block that storage block with which the lowest storage priority of the storage blocks with an assigned storage priority is associated with which the storage priority was associated first in said order. In the apparatus, the evaluation device can be configured such that the storage blocks of one storage priority in each case have associated therewith an order of the association of the respective storage priority therewith, and there is employed as a storage block that storage block with which the lowest storage priority of the storage blocks with an assigned storage priority is associated with which the storage priority was associated first in said order. The association is understood here to be the last association effected upon execution of the method. This embodiment offers the advantage that the processing data for value documents of the same storage priority can remain in the storage device for further employment as long as possible.

The assignment of a storage priority to a storage block can in principle be effected arbitrarily. Thus, it is possible to associate the storage priority with the processing data that are stored in the storage block. It is also possible to store the storage priority in the storage block together with the processing data. However, in the method, the respective storage priority is preferably assigned to the storage blocks by storing them or pointers thereto in a list for the respective storage priority. In the apparatus, the evaluation device can for this purpose preferably be configured for assigning the respective storage priority to the storage blocks by storing them or pointers thereto in a list for the respective storage priority. This has the advantage that the assignment of storage priorities, on the one hand, and the finding of storage blocks, on the other hand, can be effected very simply and fast.

In the method, the respective storage priority can also preferably be assigned to the storage blocks by storing them or pointers thereto in a concatenated list for the respective storage priority, preferably in the order of the assignment. In the apparatus, the evaluation device can be configured for assigning the respective storage priority to the storage blocks by storing them or pointers thereto in a concatenated list for the respective storage priority, preferably in the order of the association. This has the advantage that the association of storage priorities and simultaneously of the order of the association, on the one hand, and the finding of storage blocks of a pre-specified storage priority at a pre-specified place row, on the other hand, can be effected very simply and fast.

The stored processing data for value documents can be employed further in different ways. It is preferred that, preferably during the transporting, processing data are read out from storage blocks with which a pre-specified storage priority higher than the lowest storage priority is associated and the storage block is released for storing processing data. Preferably, the readout is effected in the order of decreasing storage priority when processing data for more than one storage priority are to be employed. In the apparatus, the evaluation device is preferably configured for, preferably during the transporting, reading out processing data from storage blocks with which a pre-specified storage priority higher than the lowest storage priority is associated and the storage blocks are released for storing processing data. Preferably, the readout is effected in the order of decreasing storage priority when processing data for more than one storage priority are to be employed. This has the advantage that processing data for value documents with which a high storage priority is associated can also be employed in the case of large numbers of value documents without many of said processing data being overwritten or lost. The release can be effected in principle arbitrarily, for example by removing the association of the storage priority with said storage blocks.

The read-out processing data can be employed further in arbitrary ways. Thus, it is possible that they are still employed in the evaluation device for carrying out further evaluation and/or analysis steps during the further course of the method, i.e. the transport of further value documents. Additionally or alternatively, it is possible to store the read-out processing data, after filtering or preprocessing, where applicable, in a further storage device lastingly, i.e. beyond the end of the method or the processing of the value documents. The apparatus can for this purpose have a further storage device which in particular only needs to store data more slowly than the storage device. However, it is also possible that the apparatus only has an interface, for example a network card or a USB interface or a card reader, via which processing data are transferred to the, then external, further storage device and stored there. As a further storage device there might be used in particular a hard disk or flash memory. Upon employment of a network card, the transfer can be effected to an external computer with the further storage device.

In principle it suffices, in the method, that the function according to which the storage priority is established is firmly pre-specified once. However, it is preferred that, in the method, before the beginning of the transporting there are captured trigger data by means of which the employed function is pre-specified. The apparatus can for this purpose preferably have a device for capturing trigger data, with the apparatus further being configured for, before the beginning of the transporting, capturing by means of the device trigger data by means of which the employed function is pre-specified. This embodiment allows the method to be adapted to different requirements, allowing in particular a criterion to be changed for when which storage priority is to be associated with a value document. For the device for capturing trigger data there are different conceivable possibilities, which can be employed alternatively or in connection with each other. For example, there can be employed as a device for capturing trigger data an input/output device of the apparatus, for example a touch-sensitive display ("touch screen"). This has the advantage that a user can change trigger data simply without any special auxiliary means. However, the device can also comprise an interface for transferring data, for example a network card or a USB interface or a card reader. In particular, there can be employed the interface via which processing data are also stored. The apparatus is then configured for reading in the trigger data, after capture of a user's inputs, where applicable. Trigger data are understood here to be, on the one hand, values that are employed in computations or for stipulating threshold values, or the like. On the other hand, they are also understood to be values by means of which certain partial functions can be selected which are employed in the evaluation of the pre-specified function for obtaining partial results.

The processing data can, as stated above, comprise a portion of the measuring data or all of the measuring data and/or property data. Preferably, they in addition comprise an identifier of the value document for which they were formed. The nature and extent of the processing data can in principle be firmly pre-specified. However, it is preferred that, in the method, before the beginning of the transporting there are captured data-set parameters by means of which nature and/or extent of processing data to be stored are stipulated and subsequently the processing data are stored according to the data-set parameters. This has the advantage that only data are stored that are really required. The apparatus can for this purpose have a device for capturing the data-set parameters and further be configured for, before the beginning of the transporting, capturing data-set parameters by means of which nature and/or extent of processing data to be stored are stipulated and subsequently the processing data are stored according to the data-set parameters. However, in the preferred embodiment of the apparatus mentioned in the preceding paragraph, the device for capturing trigger data preferably also serves for capturing data by means of which the processing data to be stored are stipulated.

BRIEF DESCRIPTION OF THE DRAWINGS

The invention will hereinafter be explained further by way of example with reference to the drawings. There are shown.

DETAILED DESCRIPTION OF VARIOUS EMBODIMENTS

Figure 1:
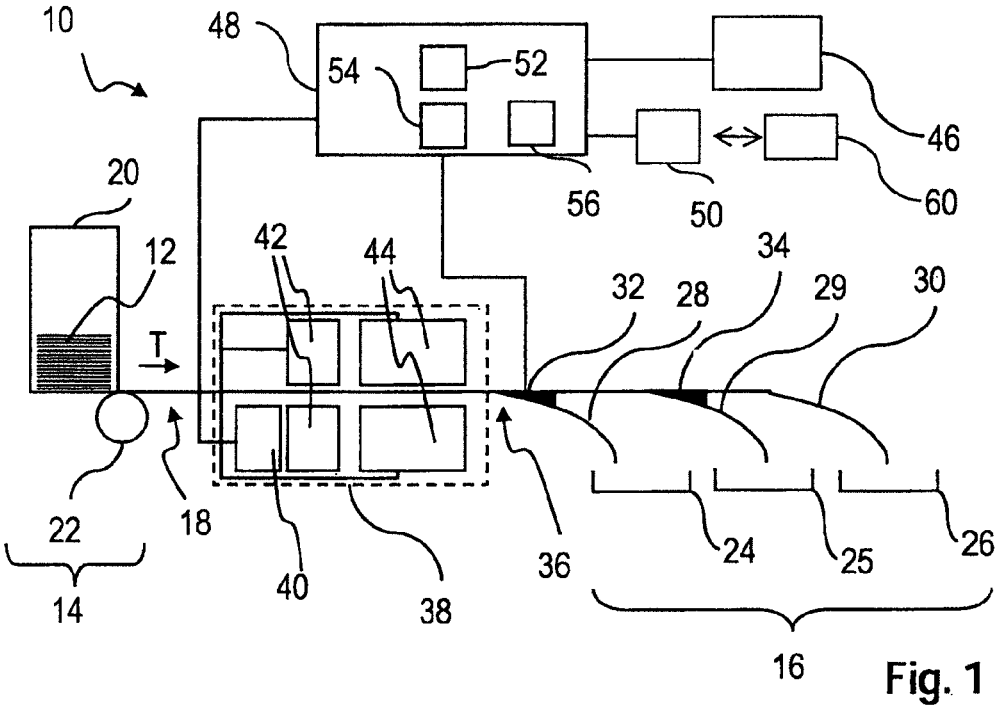
FIG. 1 a schematic view of a value-document processing apparatus in the form of a bank-note sorting apparatus, FIG. 2 a simplified flowchart of a first embodiment of a method for processing value documents that can be carried out by means of the apparatus in FIG. 1, FIG. 3 a simplified flowchart of substeps of a step S16 in FIG. 2, FIGS. 4A, B a schematic representation of the storage-block utilization before and after a step in a first stage of the method in FIG. 2, and FIGS. 5A to D a schematic representation of the storage-block utilization in the course of several steps in a second stage of the method in FIG. 2.

A value-document processing apparatus 10 in FIG. 1, in the example an apparatus for processing value documents 12 in the form of bank notes, is configured for sorting value documents in dependence on the recognition of the authenticity and of the state of processed value documents. The value-document processing apparatus processes value documents at a speed of more than 30 value documents/second, preferably more than 40 value documents/second. The hereinafter described components of the apparatus are arranged in a housing (not shown) of the apparatus or held on said housing, unless they are designated as external.

The apparatus has a feeding device 14 for feeding value documents, an output device 16 for receiving processed, i.e. sorted, value documents, and a transport device 18 for transporting singled value documents from the feeding device 14 to the output device 16.

The feeding device 14 comprises, in the example, an input pocket 20 for a value-document stack and a singler 22 for singling value documents out of the value-document stack in the input pocket 20 and for feeding the singled value documents to the transport device 18.

The output device 16 comprises, in the example, three output portions 24, 25 and 26 into which processed value documents can be sorted, being sorted according to the result of the processing. In the example, each of the portions comprises a stack pocket and a stacking wheel (not shown) by means of which fed value documents can be deposited in the stack pocket.

The transport device 18 has at least two, in the example three, branches 28, 29 and 30 at whose ends one of the output portions 24, 25, 26 is arranged in each case, and, at the branching points, gates 32 and 34, controllable by positioning signals, by means of which value documents are feedable to the branches 28 to 30 and thus to the output portions 24 to 26 in dependence on positioning signals.

On a transport path 36, defined by the transport device 18, between the feeding device 14, in the example more precisely the singler 22, and the first gate 32 after the singler 22 in the transport direction T, is arranged a sensor device 38 which measures physical properties of value documents while the value documents are being transported past and forms sensor signals rendering the measuring results. In this example, the sensor device 38 has three sensors, namely, an optical remission sensor 40 which captures a remission color image and a remission IR image of the value document, an optical transmission sensor 42 which captures a transmission color image and a transmission IR image of the value document, and a transmission ultrasonic sensor 44 which captures or measures ultrasound transmission properties of the value document in a spatially resolved manner and will hereinafter only be designated as an ultrasonic sensor for simplicity's sake. The optical sensors have a resolving power greater than 60 dpi, in the example of 125 dpi. The sensor signals formed by the sensors correspond to measuring data or raw data of the sensors which, depending on the sensor, may have already been subjected to a correction, for example in dependence on calibrating data and/or noise properties.

For capturing and displaying operator-control data, the value-document processing apparatus 10 has an input/output device 46 which comprises a display device. The input/output device 46 is realized in this example by a touch-sensitive display device ("touch screen"). In other exemplary embodiments it can comprise for example a keyboard and a display device, for example an LCD display.

An evaluation device 48, which in the present embodiment example also serves as a control device and will hence hereinafter also be designated as a control and evaluation device, is connected via signal connections to the sensor device 38, the display device 46 and the transport device 18, in particular to the gates 32 and 34. Further, a data interface 50 is connected to the control and evaluation device 48, by means of which the control and evaluation device 48 can read data sets from an external device and/or write them thereto. In the present example, the data interface 50 has a USB interface with a USB connection via which data can be read from an external storage device 60, in the example a USB storage medium, and/or be written thereto.

Upon the processing of value documents, value documents are singled out of the feeding device 14 and transported past the sensor device 38 or therethrough. The sensor device 38 captures or measures physical properties of the value document respectively transported past or through it and forms sensor signals or measuring data which describe the measurement values for the physical properties. The control and evaluation device 48 captures the sensor signals and stores corresponding measuring data at least temporarily. Further, it classifies a value document into one of pre-specified authenticity classes in dependence on the sensor signals or measuring data of the sensor device 38 for the value document and on classification parameters stored in the evaluation device, and actuates the transport device 18, here more precisely the gates 32, 34, by emitting positioning signals such that the value document is outputted in accordance with its class established upon the classification into an output portion of the output device 16 that is associated with said class. The association with one of the pre-specified authenticity classes, or the classification, is effected here in dependence on at least one pre-specified authenticity criterion.

The control and evaluation device 48 has for this purpose in particular—besides corresponding data interfaces (not shown in the figures) for the sensor device 38 or its sensors—a processor 52 and, connected to the processor 52, a storage device 54 in which is stored at least one computer program with program code upon whose execution the processor 52 controls the apparatus and evaluates the measuring data. In so doing, it establishes from the measuring data for a respective value document property data describing different properties of the value document. In particular, it can establish as property data the serial number, the readability of the serial number as well as the distribution of spots on the value document. It can evaluate the sensor signals or measuring data, in particular for establishing an authenticity class of a processed value document, and actuate the transport device 18 in accordance with the evaluation or store the measuring data. The value-document processing apparatus 10 further has, connected to the processor 52, a measuring-data storage device 56 which can be part of the control and evaluation device 48, as represented in FIG. 1, or be separate therefrom. In this embodiment example, said measuring-data storage device is a non-volatile memory, for example a hard disk.

Further, the control and evaluation device 48 actuates the input/output device 46, inter alia, to display operator-control data, and captures via said device operator-control data which correspond to an operator's inputs.

Hereinafter there will be described the aspects of the value-document processing apparatus 10 and of a method for processing value documents that concern in particular the storage of measuring data and of property data established therefrom. Upon the processing of the pre-specified value documents, data are to be captured for the purpose of capturing processing data for value documents with certain properties in order to adapt them for establishing improved classification parameters of the value-document processing apparatus 10 or for another value-document processing apparatus. However, this only requires data for value documents having certain pre-specified properties. The processing data to be stored for a value document comprise, in this embodiment example, the measuring data of the optical remission sensor and certain property data established therefrom. In this example, processing data are to captured for value documents that are in circulation, i.e. no longer freshly printed, whose serial number is not completely readable by the value-document processing apparatus 10. Further, value documents are to be captured that have spots in the region of the serial number.

Hereinafter there will be described steps of a method for processing value documents which enable the capture of such processing data for the stated value documents. Other steps connected to sorting can be assumed as known and do not need to be described further.

In the method, processing data established for a respective value document are stored intermediately, with the duration of intermediate storage depending on a storage priority which is associated with the value document, i.e. with said processing data, or with the storage block employed for storing the processing data. As a storage priority there can be associated one of a pre-specified number of discrete storage priorities. The number p of the storage priorities is pre-specified and greater than 1, in the present example 3. Processing data with increasing storage priority are to be stored longer, with the processing data for example being stored longest in storage blocks with the highest storage priority 3.

Figure 2:
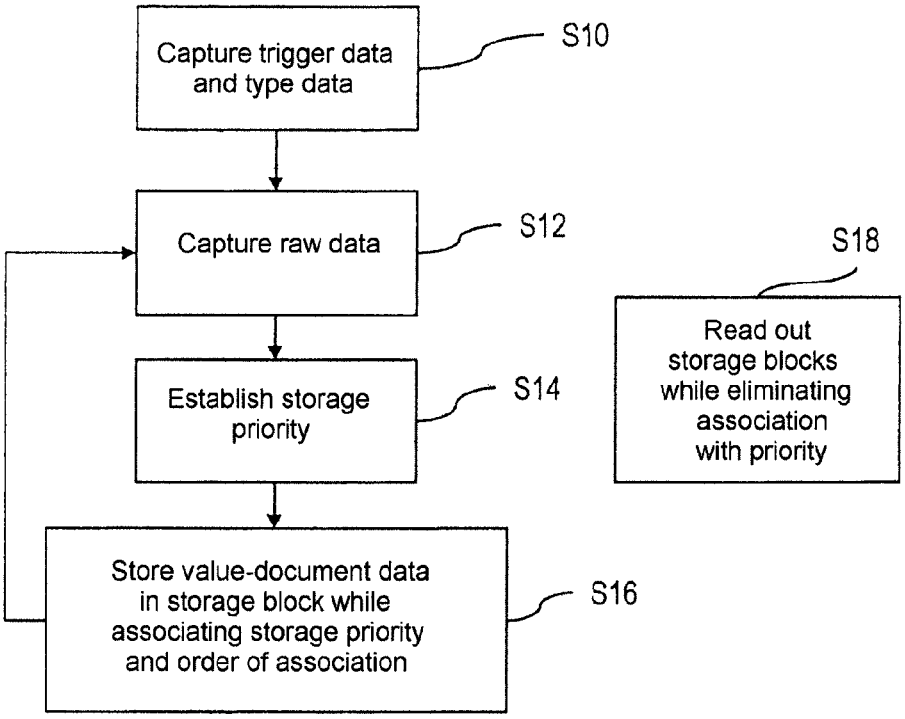

The computer program stored in the control and evaluation device 48 has instructions in order to carry out at least parts of the hereinafter described method illustrated in FIG. 2.

Before the beginning of the singling of value documents, the control and evaluation device 48, in step S10, captures by means of the input/output device 46 trigger data which serve in connection with the computer program stored in the control and evaluation device 48 for pre-specifying a function by means of which a storage priority is established for the data to be stored for a value document. Further, data-set parameters are captured which stipulate which data are stored for a respective value document.

In this example, processing data are to be captured for value documents in which the serial number cannot be read exactly enough. For this purpose, the evaluation device reads in trigger data which stipulate that the highest storage priority is associated with value documents whose serial number was not completely readable, and the second highest storage priority with value documents having spots in the region of the serial number. The processing data comprise, besides an identifier for the value document, the raw data of the optical remission sensor and property data for the serial number, such as a list of the recognized characters, as well as data characterizing the soiling in the region of the serial number.

After the capture of the trigger and data-set parameters, the control and evaluation device 48 first supplies in the storage device 54 a storage area of pre-specified storage-area size which has a number M of storage blocks. The size of each of said storage blocks is equal, and chosen so as to offer room for the data to be stored, whose extent results, inter alia, from the data-set parameters. In this embodiment example, M>100, for example M=128. At the beginning of the method, said storage blocks are contained in a list N of empty or unutilized storage blocks, i.e. storage blocks without an assigned storage priority.

Further, a data structure for a concatenated list $L_i$ (i=1, . . . p) of list entries is pre-specified for each of the p priorities. A list entry is a pointer to a storage block. Hereinafter the formulation that a storage block is at a certain place in a list will be understood for simplicity's sake to mean that the pointer to the storage block is at the place in the list. The lists are empty before the capture of the first value document, so that the storage blocks are not associated with any list.

Then, after capturing a user's starting signal which it captures by means of the input/output device 46, the control and evaluation device 48 starts the singling of the value documents.

The following steps S12 to S16 are carried out for one singled value document in each case, so that said steps are repeated until no further value document is singled and passes the sensor device 38.

In step S12, the sensor device 38 captures measuring data for a respective value document passing it. The evaluation device 48 captures the measuring or raw data of the sensor device 38 for the respective value document.

In step S14, the evaluation device establishes, employing at least a portion of the raw data, property data describing pre-specified properties of the respective value document. The raw data and the property data will hereinafter be designated as processing data. Employing at least a portion of the raw data and/or at least a portion of the property data, the evaluation device further establishes for the respective processing data a priority from the pre-specified priorities.

Figure 3:
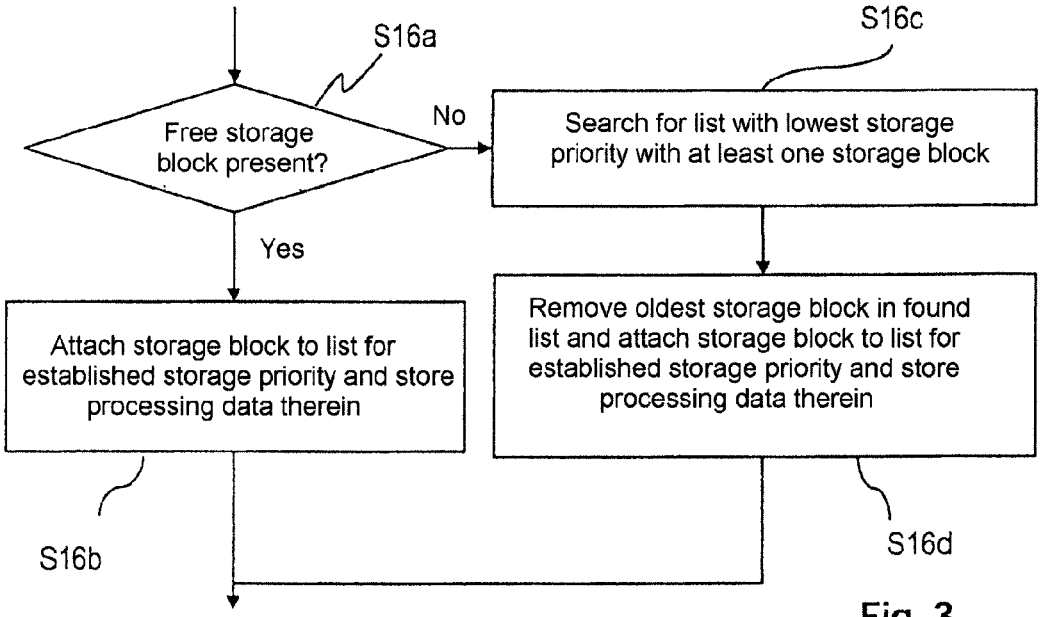

In step S16, the processing data are then stored in one of the storage blocks in dependence on the established storage priority for the respective value document. In connection with the storing of the processing data in the respective storage block, the established storage priority is associated with the respective storage block. In dependence on the established storage priority for the respective value document and in dependence on the employment of the storage blocks for storing processing data for other value documents, a storage block that has been employed for storing processing data for another value document is employed for storing the processing data of the respective value document. Substeps of the step S16 are illustrated in FIG. 3.

First, the evaluation device thus checks in step S16*a* whether at least one free storage block, i.e. a storage block with which no storage priority is associated, is available. For this purpose it only needs to check whether there is still a storage block in the list N of unutilized storage blocks.

If this is the case, the evaluation device first allocates the free storage block or, if a plurality of free storage blocks are available, one of the free storage blocks in step S16*b*. It stores the processing data in said block and adds it to the list $L_i$, which corresponds to the storage priority i established for the respective processing data, at the end thereof. At the same time it removes the storage block from the list of the unutilized storage blocks. Thereafter the method is continued with step S12.

If, on the other hand, the check yields that no free storage block is available or standing by, a storage block from one of the lists $L_i$ must be employed. The processing data hitherto stored therein are then no longer present in the storage device. In this embodiment example, there is employed as a storage block a storage block with which the lowest storage priority of the storage blocks with an associated storage priority is associated. For this purpose, the evaluation device first, in step S16*c*, establishes the list of lowest storage priority containing at least one storage block. In step S16*d*, the evaluation device removes from said list the oldest data block, i.e. the one at the head of the list, from the list and employs it for the current processing data. It stores the processing data therein and attaches it to that one of the lists that is provided for the established storage priority or storage blocks of the established storage priority. Depending on the storage priority for the current processing data, the storage block can hence thereafter be in the same or another list respectively at the end thereof.

Thereafter the method is continued with step S12.

In this manner, processing data of high storage priority can be held in the storage device very long and employed later.

Between the stated steps and/or parallel thereto, processing data are read out from storage blocks with which a pre-specified storage priority higher than the lowest storage priority is associated, at relatively long intervals, for example after 100 value documents, in the step S18. The storage blocks are then released for storing processing data. For this purpose, the storage blocks are removed from the respective list, causing them to no longer have a priority associated therewith. They can then be employed as unassigned, or free, storage blocks. They can then be included in the list N of unutilized storage blocks. In the present example, the processing data of the highest storage priority, i.e. of the storage priority 3, are read out first, beginning at the head of the list.

The read-out processing data are stored in the further storage device, the mass storage device 56. From there they can later be transferred to the storage medium 60 via the interface 50.

Figure 4A:
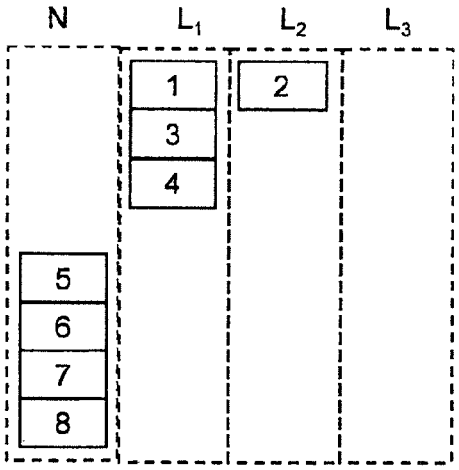
Figure 4B:
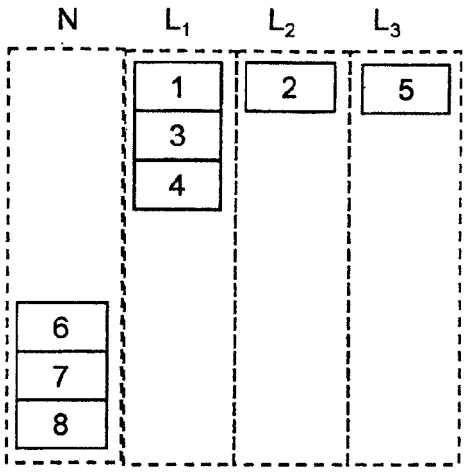

The sequence for two stages of the method is illustrated in simplified form in FIGS. 4A and 4B as well as 5A to 5D for eight storage blocks. The boxes drawn with dashed lines represent concatenated lists of unemployed storage blocks (N), concatenated lists of the storage priority 1 ($L_1$), the storage priority 2 ($L_2$) and the storage priority 3 ($L_3$).

FIG. 4A represents a stage in which four storage blocks 5 to 8 are unemployed, three storage blocks 1, 3 and 4 with processing data for value documents with storage priority 1 have the lowest storage priority 1 associated therewith, and the storage block 2 with processing data for a value document with storage priority 2 the middle storage priority 2. Storage blocks represented higher up have been added to the list sooner than ones further down. For the following value document the storage priority 3 is established. Thereupon the processing data are written to the unemployed storage block 5; the storage block 5 is then attached to the list for storage priority 3, being written to the list as the first element in this example. The result is shown in FIG. 4B.

Figure 5A:
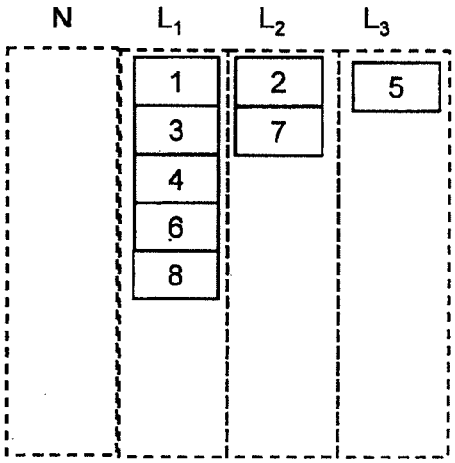

FIG. 5A represents another stage of the method in which the storage blocks 1, 4, 6 and 8 are in the list for the storage priority 1, the storage blocks 2 and 7 in the list for the storage priority 2, and the storage block 5 is found in the list for the storage priority 3. The list of unutilized storage blocks is empty, in contrast.

Figure 5B:
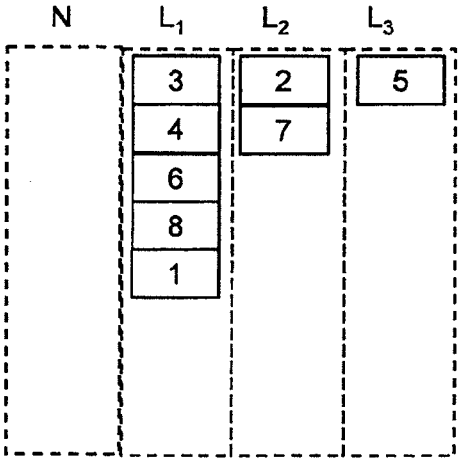

For a current value document and thus for the processing data captured or established therefor, the storage priority established was the storage priority 1. It is now checked whether an unemployed storage block is present. Since the corresponding list is empty and therefore no such storage block is present, the list of the lowest storage priority containing storage blocks is thereupon established. This is the list for the storage priority 1. The storage block that has been therein longest and is thus highest up in FIG. 5A, the storage block 1, is removed from the list and employed for storing the current processing data. Since the storage priority 1 was established for the value document or the processing data, said storage block is assigned the storage priority 1, by being added to the list for the storage priority 1 at the end thereof. This is illustrated in FIG. 5B.

Figure 5C:
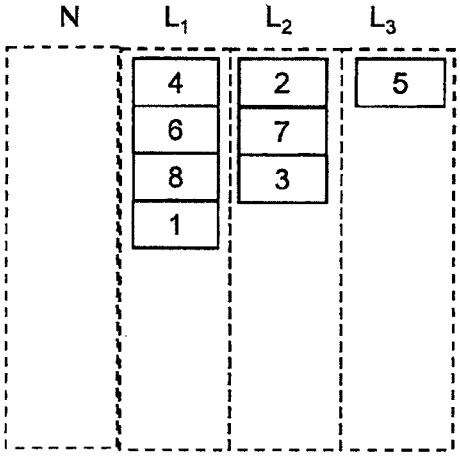

For a following value document and thus the processing data captured or established therefor, the storage priority established was the storage priority 2. It is now checked whether an unemployed storage block is present. Since the corresponding list is empty and therefore no such storage block is present, the list of the lowest storage priority containing storage blocks is thereupon established. In the situation represented in FIG. 5B, this is the list for the storage priority 1. The storage block that has been therein longest and is thus highest up in FIG. 5B, the storage block 3, is removed from the list and employed for storing the current processing data. Since the storage priority 2 was established for the value document or the processing data, said storage block is assigned the storage priority 2, by being added to the list for the storage priority 1 at the end thereof. This is illustrated in FIG. 5C.

Figure 5D:
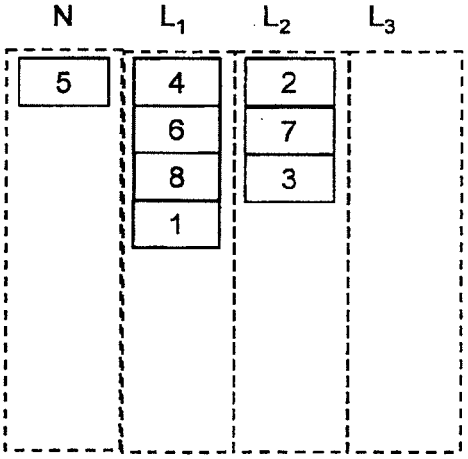

Subsequently, the processing data are read out from the storage blocks of the highest storage priority, the storage priority 3, and employed further. The only storage block located therein is the storage block 5, for which the association of the storage priority is eliminated by removing said block from the list for the storage priority 3 and attaching it to the list of the unemployed storage blocks. The resultant state is illustrated in FIG. 5D.

A further embodiment example differs from the first embodiment example in that it is additionally checked in step S16 whether the sum of the numbers of the storage blocks in the lists for the storage priority 1 and for unemployed storage blocks undershoots a pre-specified lower limiting value. If this is not the case, the method is continued as in the first exemplary embodiment. Otherwise, the control and evaluation device 48 stops the singling. The value documents still located in the transport path are processed further, with corresponding processing data being stored as in the first embodiment example. The lower limiting value is chosen in dependence on the processing speed, the length of the transport line from the singler to the sensor device 38, and the number of the available storage blocks, such that processing data in the lists for the storage priorities greater than the lowest storage priority could be stored if corresponding storage priorities are established therefor. The processing data in storage blocks in the lists for the storage priorities greater than the lowest storage priority can then be read out and stored as in the first embodiment example. Further, the operator can remove the corresponding value documents from the output pockets.

Other embodiment examples differ from the above-depicted embodiment examples in that no list of unutilized storage blocks is employed, but rather unutilized storage blocks are assigned the lowest storage priority. Then all storage blocks are associated with the list with the lowest priority at the beginning. Upon a release of a storage block, it is attached to the list of the lowest priority.

Other embodiment examples differ from the above-depicted embodiment examples in that the evaluation device reads the trigger data from an external storage device 60 via the data interface 50.

Further embodiment examples can differ from the preceding ones in that the processing data also contain, as property data, data comprising the skew of the bank notes, i.e. the deviation of the direction of the bank-note edge extending substantially longitudinally to the transport direction from the transport direction.

Still other embodiment examples differ from the above-depicted embodiment examples by the function for establishing the storage priority. The storage priority is established as higher when the value document, upon the capture of the measuring data, has an adequately good position relative to the sensor device 38, i.e. the value document's edge extending substantially in the transport direction is rotated relative to the transport direction at most by a pre-specified angle, for example an angle of 5°, and said edge is less than a pre-specified distance away from a pre-specified center of the transport path or capture region of the sensor device. Simultaneously, the serial number is to be unreadable. For this purpose the measuring data of the optical remission sensor 40 are employed in this example.

Further, only those value documents are given a storage priority greater than the lowest storage priority that have a correct value-document type according to the captured trigger data, and a correct orientation. For this purpose the measuring data of the optical remission sensor 40 are employed in this example.

In other embodiment examples, the function for establishing the storage priority can also be so pre-specified that processing data for unexpected or unidentifiable value documents or value-document-like sheets and those for value documents recognized as forgeries are stored with highest priority.

Further embodiment examples differ from the preceding embodiment examples in that there is provided as a data interface 50 a network interface, preferably a cable-type network interface, for example, a Gigabit Ethernet interface. The external storage device 60 is then given by a storage device connected by means of the network interface, for example a hard disk of a set-off computer.

Still further embodiment examples can differ from the preceding embodiment examples in that the storage device 56 is omitted and storage operations, i.e. the storing of the processing data, are effected directly by means of the data interface 50 in the further, now external, storage device 60.

Further embodiment examples differ from the above-depicted embodiment examples in that no storage blocks of pre-specified size are employed. Rather, the size of the storage blocks is determined by the processing data to be respectively stored for a value document. Step S16*a* is then changed in that in a step S16*a*' it is checked whether there is still an unutilized part available in the storage area that can be employed as a storage block for the present processing data. Otherwise, step S16*a*' is unchanged over step S16*a*.

If this is the case, in a step S16*b*' changed over step S16*b*, the storage block is allocated with a size that is sufficient for storing the processing data. The other processes of the step S16, in particular the attaching to the list and the storing of the processing data, are then unchanged.

If there is no longer a sufficiently large part of the storage area available for storing the processing data, a step S16*c*' is carried out which differs from step S16*c* only in that the list of the lowest priority is searched for in which a storage block or, if necessary, enough storage blocks are available that can be employed as a storage block for the processing data to be stored. A step S16*d*' is then performed which differs from step S16*d* only in that the storage block or blocks are removed from the found list and the part of the storage area occupied thereby is released. The part of the storage area that has thus become free is then employed for allocating the new storage block for the processing data to be stored. The storage block is then treated further as in step S16*d*.

Still other embodiment examples differ from the preceding embodiment examples in that step S18 is omitted. The processing data are then stored beyond the end of the singling of the value documents in any case and can then be employed for further analysis. In particular, the processing data with highest storage priority can be held after processing of a value-document stack and be taken over upon processing of another value-document stack. In this manner, processing data with highest storage priority can for example be collected over a shift in which a user processes value documents.

The invention claimed is:

1. A method for processing value documents, employing a storage device for data which has a storage area of pre-specified storage-area size, wherein:

value documents are transported in singled form to a sensor device;

for a respective value document there are captured by means of the sensor device measuring data which describe at least one physical property of the value document;

for the respective value document a storage priority is established as a pre-specified function at least of a portion of the measuring data that is necessary for establishing the storage priority;

in dependence on the established storage priority, processing data for the respective value document are stored in a storage block in the storage area, wherein the processing data comprise at least a portion of the measuring data that is provided for storage and/or property data for at least one property of the value document which are established employing at least a portion of the measuring data that is necessary for establishing the property; and wherein the storage priority influences the duration of the storage of the respective processing data.

2. The method according to claim 1, wherein in dependence on the established storage priority for the respective value document and in dependence on the employment of the storage blocks for storing processing data for other value documents, a storage block that has been employed for storing processing data for another value document is employed for storing the processing data of the respective value document.

3. The method according to claim 1, wherein the storage blocks of one storage priority in each case have associated therewith an order of the association of the respective storage priority, and there is employed as a storage block that storage block with which the lowest storage priority of the storage blocks with an associated storage priority is associated with which the storage priority was associated first in said order.

4. The method according to claim 1, wherein processing data are read out from storage blocks with which a pre-specified storage priority higher than the lowest storage priority is associated and the storage blocks are released for storing processing data.

5. The method according to claim 1, wherein, before the beginning of the transporting there are captured trigger data by means of which the employed function is pre-specified.

6. The method according to claim 1, wherein, before the beginning of the transporting there are captured data-set parameters by means of which nature and/or extent of processing data to be stored are stipulated.

7. The method according to claim 1, wherein in connection with the storing of the processing data in the respective storage block, the established storage priority is associated with the respective storage block, there being employed as a storage block, if available, a part of the storage area that contains no storage block or no part of a storage block with which a storage priority is associated, or there being employed as a storage block, if no such part of the storage area is available, a part of the storage area that has at least one storage block with which the lowest storage priority of the storage blocks with an associated storage priority is associated, or there being employed as a storage block a part of the storage area that comprises at least one storage block with which the lowest storage priority of the storage blocks with an associated storage priority is associated.

8. The method according to claim 7, wherein the respective storage priority is associated with the storage blocks by storing them or pointers thereto in a list for the respective storage priority.

9. The method according to claim 7, wherein the respective storage priority is associated with storage blocks by storing them or pointers thereto in a concatenated list for the respective storage priority, preferably in the order of the assignment.

10. The method according to claim 1, wherein the storage blocks have a pre-specified size.

11. The method according to claim 10, wherein in connection with the storing of the processing data in the respective storage block, the established storage priority is associated with the respective storage block, there being employed as a storage block, if available, a storage block with which no storage priority is associated, or there being employed as a storage block, if no such storage block is available, a storage block with which the lowest storage priority of the storage blocks with an associated storage priority is associated, or there being employed as a storage block a storage block with which the lowest storage priority of the storage blocks with an associated storage priority is associated.

12. An apparatus for processing value documents, comprising:

a transport device which is configured for transporting singled value documents;

a sensor device which is set up for capturing, for one of the value documents transported by the transport device in each case, measuring data which describe at least one physical property of the value document; and an evaluation device which has at least a processor and a storage device which has a storage area of pre-specified storage-area size;

wherein the apparatus is configured for performing a method according to claim 1, wherein measuring data of the sensor device are employed by the evaluation device, and the storage device of the evaluation device as a storage device.

13. The apparatus according to claim 12, which has a device for capturing trigger data, wherein the apparatus is further configured for, before the beginning of the transporting, capturing by means of the device trigger data by means of which the employed function is pre-specified.

14. The apparatus according to claim 13, wherein the device for capturing trigger data also serves for capturing data by means of which the processing data to be stored are stipulated.

* * * * *